US005901958A

United States Patent [19]

Andrews

[11] Patent Number: 5,901,958

[45] Date of Patent: May 11, 1999

[54] METHOD OF PLAYING A ROYAL CARD STUD POKER GAME AT A CASINO GAMING TABLE

[76] Inventor: Douglas S. Andrews, 6168 Meadow View La., Las Vegas, Nev. 89103

[21] Appl. No.: 08/980,799

[22] Filed: Dec. 1, 1997

[51] Int. Cl.[6] ..... A63F 1/00

[52] U.S. Cl. ..... 273/292

[58] Field of Search ..... 273/292, 303, 273/304, 306, 274

[56] References Cited

U.S. PATENT DOCUMENTS

| | | | |
|---|---|---|---|
| 5,544,892 | 8/1996 | Breeding | 273/292 |
| 5,653,444 | 8/1997 | Dahl | 273/292 X |
| 5,657,993 | 8/1997 | Merlino et al. | 273/292 |
| 5,718,430 | 2/1998 | Aramapakal et al. | 273/292 |
| 5,735,524 | 4/1998 | Wisted | 273/292 X |
| 5,762,340 | 6/1998 | Feola | 273/292 |
| 5,769,422 | 6/1998 | Stromer | 273/292 X |

*Primary Examiner*—William E. Stoll
*Attorney, Agent, or Firm*—Philip D. Junkins

[57] ABSTRACT

A method of playing at a gaming table a player-versus-paytable five-card stud poker game for up to seven players utilizing the 20 royal cards of a standard 52-card poker deck as a royal deck of cards with player awards based upon predetermined amounts related to a paytable of winning five-card hands. Bet wagers are initially accepted from each player at the gaming table Up to three cards are dealt face-down to each of the occupied player positions at the table and up to three cards from the royal deck of cards are dealt face-down to a dealer position at the table Each player, after viewing the dealt cards, is permitted to stand on the bet wager or double the bet wager after which one of the face-down cards at the dealer position is up-turned for use as a community card by the players. Each player is then permitted to stand on the hand and bets or triple the bet wager after which the remaining face-down card or cards at the dealer position are up-turned for use as a community card by the players. Each player hand is up-turned and the hand, incorporating the community cards at the dealer position, is evaluated to determine whether or not such hand is a winning hand with respect to the paytable of winning hands with each winning hand paid off in accordance with the paytable

11 Claims, 1 Drawing Sheet

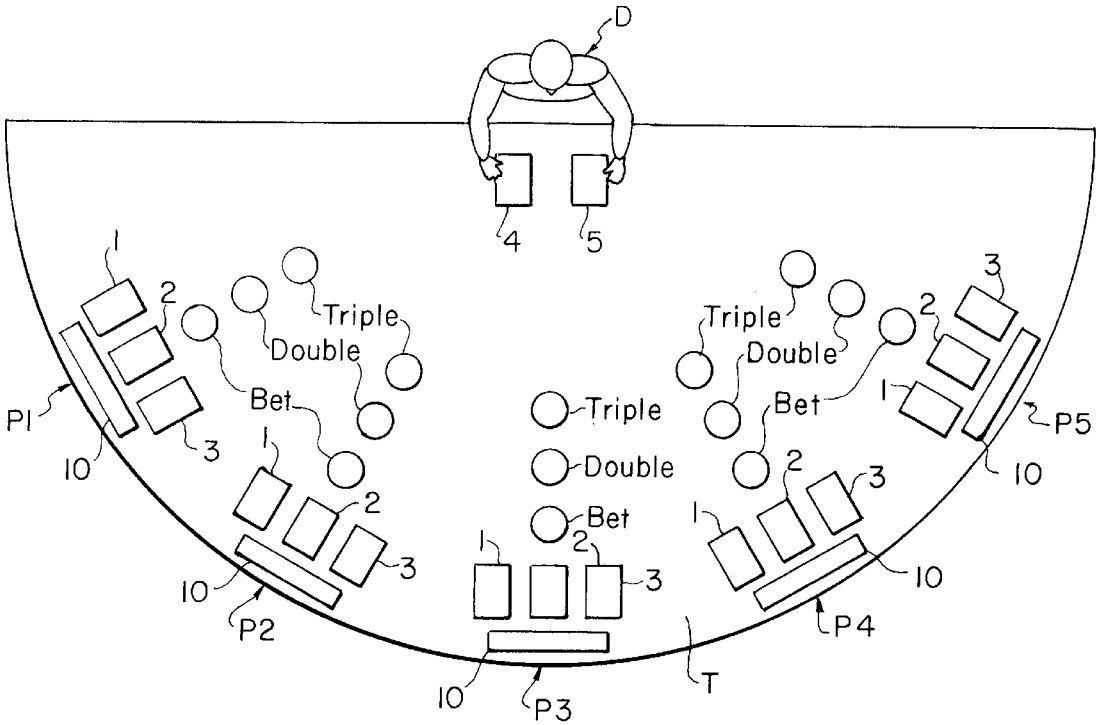
D
4
5
1
2
3
Triple
Double
Bet
P1
10
P2
P3
P4
P5
T

METHOD OF PLAYING A ROYAL CARD STUD POKER GAME AT A CASINO GAMING TABLE

BACKGROUND OF THE INVENTION

1. Field of the Invention

The present invention relates to five-card stud poker games and, more particularly, to multiple player five-card stud poker games in which each player plays against the dealer (not against the other players) and in which each player places an initial "bet" wager before being dealt (face-down) a partial poker hand or a five-card poker hand. In such games the dealer also deals to himself or herself a number of dealer's cards with at least several of such cards dealt face-up. Each player thereupon compares his or her cards with the dealer's face-up cards providing the player with opportunity to decide whether or not to surrender the hand (and the player's original "bet" wager) or to place an "additional" wager on the hand as dealt or in anticipation of receiving the remainder of a five-card poker hand or exchanging one or more of the original cards of a five-card hand with replacement dealer dealt cards.

In some "player-versus-dealer" five-card stud poker games the dealer may add face-up cards in sequence to his or her partial hand with player "additional" wagering upon each addition of a card to the dealer's hand. Further, where the dealer's hand (as originally dealt) comprises five cards, the dealer may turn one or more cards face-up in sequence with player "additional" wagering upon each dealer card turn-up. In either of the foregoing (or other) variations of "player-versus-dealer" five-card stud poker games, the individual player may surrender his or her hand (with any and all wagers) after any wagering round. In such games each player having a higher value hand with respect to the dealer's hand wins the amount of his or her wagers from the dealer.

Where the dealer merely deals cards in turn to each player, with the players competing against one-another and not the dealer, a uniform pre-deal "ante" wager is usually made by each player and a post-deal "additional" wager ensues. Each player thereafter may in turn request substitute cards, i.e. draw cards, for his or her hand discarding the cards for which substitute cards are dealt. Thus, this form of poker is termed "draw poker" and further "additional" wagering ensues for one or more player-raise rounds. The highest value player hand wins the amount of all "ante" wagers and "additional" wagers (the "pot") from all of the players.

2. Description of Related Prior Art

Poker is one of the most exciting gambling games because it includes for each individual player a mix of skill, luck, and psychology. Throughout the world millions of players try their luck each year at the game of poker at card tables in gaming rooms and casinos.

Five-card draw poker is typically played in two basic formats, i.e., between players or between individual players and a house dealer. Many players prefer a player-versus-player game because it involves the elements of inter-player skill and psychology, the latter element including a player's ability to bluff the strength of his or her hand versus the assumed strength of the hands of the other players. Many other players prefer to play a "stud" form of poker against at a standard gaming table against a house dealer or against a paytable of hands because such a table game play tends to minimize the elements of skill and psychology with each player relying principally on luck.

There remains a need in the gaming room and casino businesses for stud poker type games which can be played at a standard gaming table and which provide an appropriate mix of the elements of player skill, psychology and luck along with a speed-up of game play time and the excitement of involving royal card hands.

OBJECTS AND SUMMARY OF THE INVENTION

The present invention comprises a method of playing a related variety five-card stud poker games limited to the use of the four royal flush hands (twenty cards) available in a standard 52 card deck with the games being most suitable for a player-versus-paytable game format at the gaming tables commonly available in public and private gaming rooms and casinos In a preferred embodiment for up to five players, the method comprises the steps of:

a) accepting from each player an initial "bet" wager placed in front of the player on the game table at his or her play position at the table;

b) dealing alternately three cards face-down to each of the players in rotation from the deck of 20 cards (all of the 10s, jacks, queens, kings and aces of a standard deck) and dealing two cards face-down during the first and second rotation or during the second and third rotation to a dealer position on the table;

c) permitting each player, in sequence, after viewing his or her three cards, to either stand on the "bet" wager, or double the "bet" wager by placing an equivalent "additional" wager in front of his or her play position;

d) displaying one of the dealer's two cards as a face-up community card for review by each player to be used as the fourth card of the player's hand;

e) permitting each player in the game, in sequence, after viewing the dealer face-up card, to stand on his or her present wagers, or to triple his or her "bet" wager by placing a second equivalent "additional" wager in front of his or her play position and thereafter turning face-up his or her dealt three cards;

f) displaying the second of the dealer's two cards as a second face-up community card for use by each player as the fifth card of the player's hand; and g) evaluating each of the remaining player's completed hands by the dealer to determine whether or not such hand or hands comprises a winning hand in accordance with the paytable for the game followed by pay-off of the winning hands.

For the above preferred embodiment of the royal five-card stud poker game of the invention the paytable may comprise:

i) loss of a player's wagers for a hand displaying two pairs or less of cards;

ii) even payoff of the player's wagers for a hand displaying three of a kind cards;

iii) a 3 to one payoff of the player's wagers for a hand displaying a five card straight;

iv) a 6 to one payoff of the player's wagers for a hand displaying a full house of cards;

v) a 15 to one payoff of the player's wagers for a hand displaying four of a kind cards; and vi) a 100 to one payoff of the player's wagers for a hand displaying a royal flush of cards.

It is to be noted that there would be no differentiation of payoff odds for any four of a kind hands and the only flush combination of cards must comprises a royal flush since the number of cards utilized in the game is limited to the 20 cards forming the four royal card suits.

An additional preferred embodiment of the royal five-card stud poker game method of the invention comprises a game for up to seven players at a standard gaming room or casino gaming table with the players only being dealt alternately two cards face-down with the dealer dealing to himself or herself three cards face-down and with player wagering before the deal rotations (the initial "bet" wager) and after the deal rotations and the turn-up in sequence of the dealer's face-down cards. The paytable and win odds for this alternative game embodiment are the same as set forth for the embodiment first described above. Other variations of the basic royal five-card stud poker game method of the invention include the addition to the twenty cards comprising the four royal flush sets of a standard 52 card deck of cards of a duce as a wild card, a joker as a wild card, any other low card (below a 10), in which cases the game win odds are slightly diminished.

It is a principal object of the present invention to provide a player-versus-paytable five-card stud poker game involving only the royal hand cards of a standard 52 card deck.

It is a further object of the invention to provide a player-versus-paytable five-card stud poker game for up to seven players involving the 20 cards forming the four suits of royal cards of a standard 52 card deck and which involves an appropriate mix of the elements of player skill, psychology and luck with a speed-up of game play time and the excitement of obtaining a royal flush as a high payoff hand.

BRIEF DESCRIPTION OF THE DRAWING FIGURE

The objects and features of the present invention, which are believed to be novel, are set forth with particularity in the appended claims The present player-versus-paytable royal stud poker game of the invention, both as to its organization and manner of play, together with further objects and advantages, may best be understood by reference to the following description, taken in connection with the accompanying drawing FIGURE.

The drawing FIGURE shows a top plan view of a gaming table for playing a preferred version of the game method of the present invention, the variety of the games of the invention being played within the method termed generally herein "Royal Poker", "Royal Card Poker" or "Royal Stud Poker".

DETAILED DESCRIPTIONS OF PREFERRED EMBODIMENTS

The following description is provided to enable any person skilled in the gaming art to organize and use the invention and sets forth the best modes contemplated for carrying out the game method of the invention. Various modifications of the method, however, will become readily apparent to those skilled in the gaming art, since the basic principles of the present game method will have been specifically provided hereinafter as a unique method of playing a player-versus-dealer five-card stud poker game.

1. Description of a First Preferred Embodiment of the "Royal Poker", "Royal Card Poker" or "Royal Stud Poker" Game of the Invention.

The first preferred version of the game method of the present invention uses the 20 royal flush cards (4 10s, 4 jacks, 4 queens, 4 kings and 4 aces) from the four card suits of a standard 52-card poker deck. These 20 cards are shuffled and formed into a deck of cards hereinafter referred to as the "royal deck of cards." The game method of the first preferred version is designed to serve five players. The drawing FIGURE shows a common semi-circular gaming table T arranged with five player positions P1, P2, P3, P4 and P5 and a game card dealer D positioned across the table facing the players. In front of each player there is located a sequence of three wagering circles labeled "bet", "double" and "triple" within which each player may place his or her initial "bet" wager and optional first and second "additional" wagers.

The drawing FIGURE also shows three cards numbered 1, 2 and 3 at each player position on the gaming table and two cards numbered 4 and 5 at the dealer position on the gaming table. These cards are dealt alternately face-down to the player positions and dealer position in rotation from the royal deck of cards. Poker chip or coin trays 10 may also be provided at each of the player positions on the game table T.

Before dealing any cards from the royal deck of cards the players at the gaming table place their individual initial "bet" wager in the wagering circle in front of their respective player position. Thereafter, the game cards are dealt by the dealer face-down in rotation sequence to the player positions and dealer position as indicated hereinbefore. Following the distribution of royal deck cards as indicated, the players individually and privately look at their respective three card hands comprised of cards 1, 2 and 3. The players are then permitted, in sequence, to either stand pat on the "bet" wager, or double the "bet" wager by placing a first equivalent "additional" wager in the "double" circle on the gaming table in front of his or her player position at the table.

Following the placing of all first "additional" wagers by the game players, the dealer displays (by upturn) one of the face-down cards at the dealer position as a first face-up community card for review by each player and visual incorporation as a card of the player's hand. The players are then permitted, in sequence, to either stand pat on his or her present wagers, or triple his or her "bet" wager by placing a second equivalent "additional" wager in the "triple" circle on the gaming table in front of his or her player position at the table. Following the placing of all second "additional" wagers by the remaining game players, the dealer displays (by upturn) the other of the face-down cards at the dealer position as a second face-up community card for review by each player and visual incorporation as a fifth card and completion of the player's hand. The remaining players thereupon upturn their face-down cards for evaluation of their completed hands to determine whether or not such hands comprise winning five-card stud poker hands in accordance with the paytable applicable to the game.

For the five-card stud poker game described above the paytable may comprise for final hands displaying:

Two pairs or less—loss of wagers

Three of a kind—even payoff of wagers

Five card straight—3 to 1 payoff of wagers

Full house—6 to 1 payoff of wagers

Four of a kind—15 to 1 payoff of wagers

Royal flush—100 to 1 payoff

It is to be noted that there would be no differentiation of payoff odds for any four of a kind hands and the only possible flush combination of cards must comprise a royal flush.

2. Description of a Second Preferred Embodiment of the "Royal Poker", "Royal Card Poker" or "Royal Stud Poker" Game of the Invention.

The second preferred version of the game method of the present invention also uses the 20 royal flush cards from the four card suits of a standard 52-card poker deck. These 20 cards are shuffled and formed into a "royal deck of cards" as is the case with the first preferred embodiment of the five-card stud poker method of the invention. The game method of the second preferred version, however, is designed to serve seven game players . Thus, the semi-circular gaming table of the drawing FIGURE would therefore be re-arranged to provide for seven player positions with a game dealer positioned across the table facing the players. In this game version, in front of each player, there is also located a sequence of three wagering circles labeled "bet", "double" and "triple" within which each player may place his or her initial "bet" wager and optional first and second "additional" wagers.

Whereas the drawing FIGURE shows three cards numbered 1, 2 and 3 at each player position on the gaming table and two cards numbered 4 and 5 at the dealer position on the gaming table, in the second preferred embodiment of the five-card stud poker method of the invention only two cards (cards 1 and 2) are dealt to each player position and three cards are dealt at the dealer position on the gaming table. These cards are dealt alternately face-down to the player positions and dealer position in rotation from the royal deck of cards with the third card dealt to the dealer position placed face-up as a first community card for visual incorporation as a card of each player's hand.

Before dealing any cards from the royal deck of cards the players at the gaming table place their individual initial "bet" wager in the wagering circle in front of their respective player position. Thereafter, the game cards are dealt by the dealer face-down in rotation sequence as indicated above with the exception that the last of the three cards dealt to the dealer position is dealt face-up. Following the distribution of the royal deck cards as indicated, the players individually and privately look at their respective two card hands comprised of cards 1 and 2 and evaluate such cards in combination with the face-up community card at the dealer position. The players are then permitted, in sequence, to either stand pat on the initial "bet" wager, or double the "bet" wager by placing a first equivalent "additional" wager in the "double" circle on the gaming table in front of his or her player position at the table.

Following the placing of all first "additional" wagers by the game players, the dealers displays (by upturn) one of the face-down cards at the dealer position as a second face-up community card for review by each player and visual incorporation as a card of each player's hand. The players are then permitted, in sequence, to stand pat on his or her present wagers, or triple his or her "bet" wager by placing a second equivalent "additional" wager in the "triple" circle on the gaming table in front of his or her player position at the table. Following the placing of all second "additional" wagers by the game players, the dealer displays (by upturn) the other of the face-down cards at the dealer position as a third face-up community card for review by each player and visual incorporation as a fifth card and completion of the player's hand. The payers thereupon upturn their face-down cards for evaluation of their completed hands to determine whether or not such hands comprise winning five-card stud poker hands in accordance with the paytable applicable to the game.

For the five-card stud poker game version described above the paytable may comprise the paytable set forth in the first preferred embodiment of the invention. Variations in the paytable may occur where a wild card is incorporated in the "royal deck of cards". Other variations in the method of the royal five-card stud game of the invention may relate to the manner in which the 2 or 3 cards are dealt to the player positions and the manner in which the 3 or 2 cards are dealt to the dealer position.

Those skilled in the gaming art will appreciate that various adaptations and modifications of the above described preferred method embodiments of the present invention can be configured without departing from the scope and spirit of the invention. Therefore, it is to be understood that, within the scope of the appended claims, the invention may be practiced other than as specifically described herein.

What is claimed is:

1. A method of playing at a gaming table a player-versus-paytable five-card stud poker game for up to seven players utilizing the 20 royal cards of the four card suits of a standard 52-card poker deck as a royal deck of cards with player awards based upon predetermined amounts related to a paytable of winning five-card hands, said method comprising:

a) accepting from each player at a player position at said gaming table an initial "bet" wager;

b) dealing alternately up to three cards face-down to each of the occupied player positions on said gaming table in rotation from said royal deck of cards and dealing up to three cards face-down from said royal deck to a dealer position on said gaming table;

c) permitting each player, in sequence, after viewing his or her dealt cards, to either stand on the "bet" wager and dealt cards or double the "bet" wager by placing a first equivalent "additional" wager in front of his or her player position;

d) displaying one of the face-down cards at the dealer position as a first face-up community card for review by each player to be used as a card of the player's hand;

e) permitting each player in the game, in sequence, after viewing said first face-up community card, to either stand on his or her present wagers, or triple his or her "bet" wager by placing a second equivalent "additional" wager in front of his or her player position;

f) displaying the remainder of the face-down cards at the dealer position as one or two additional face-up community cards for review by each player to be used as cards to complete the player's hand; and g) evaluating each of the player's completed hands to determine whether or not said hands comprise winning hands in accordance with said paytable of winning five-card hands and paying off said winning hands.

2. The method of claim 1 wherein the 20 card royal deck of cards utilized in said five-card stud poker game has added thereto a duce card as a wild card for use by a player in his or her hand comprised of up to three dealt cards and as may be included in his or her hand as a community card at the dealer position.

3. The method of claim 1 wherein the 20 card royal deck of cards utilized in said five-card stud poker game has added thereto a joker card as a wild card for use by a player in his or her hand comprised of up to three dealt cards and as may be included in his or her hand as a community card at the dealer position.

4. The method of claim 1 wherein said five-card stud poker game is limited to up to five players and each player is dealt in rotation from said royal deck of cards three cards face-down and two cards from said deck are dealt face-down to the dealer position.

5. The method of claim 1 wherein said five-card stud poker game is limited to up to seven players and each player is dealt in rotation from said royal deck of cards two cards face-down and three cards from said deck are dealt face-down to the dealer position.

6. A method of playing at a gaming table a player-versus-paytable five-card stud poker game for up to five players utilizing the 20 royal cards of the four card suits of a standard 52-card poker deck as a royal deck of cards with player awards based upon predetermined amounts related to a paytable of winning five-card hands, said method comprising:

a) accepting from each player at a player position at said gaming table an initial "bet" wager;

b) dealing alternately three cards face-down to each of the occupied player positions on said gaming table in rotation from said royal deck of cards and dealing two cards face-down from said royal deck to a dealer position on said gaming table;

c) permitting each player, in sequence, after viewing his or her dealt cards, to either stand on the "bet" wager and dealt cards, or double the "bet" wager by placing a first equivalent "additional" wager in front of his or her player position on said gaming table;

d) displaying a first face-down card at the dealer position as a first face-up community card for review by each player to be used as a card of the player's hand;

e) permitting each player in the game, in sequence, after viewing said first face-up community card, to either stand on his or her present wagers, or triple his or her "ante" wager by placing a second equivalent "additional" wager in front of his or her player position;

f) displaying the second face-down card at the dealer position as a second face-up community card for review by each player to be used as a card to complete the player's hand; and g) evaluating each of the player's completed hands to determine whether or not said hands comprise winning hands in accordance with said paytable of winning five-card hands and paying off said winning hands.

7. The method of claim 6 wherein the 20 card royal deck of cards utilized in said five-card stud poker game has added thereto a duce card as a wild card for use by a player in his or her hand comprised of the three dealt cards and as may be included in his or her hand as a community card at the dealer position.

8. The method of claim 6 wherein the 20 card royal deck of cards utilized in said five-card stud poker game has added thereto a joker card as a wild card for use by a player in his or her hand comprised of the three dealt cards and as may be included in his or her hand as a community card at the dealer position.

9. A method of playing at a gaming table a player-versus-paytable five-card stud poker game for up to seven players utilizing the 20 royal cards of the four card suits of a standard 52-card poker deck as a royal deck of cards with player awards based upon predetermined amounts related to a paytable of winning five-card hands, said method comprising:

a) accepting from each player at a player position at said gaming table an initial "bet" wager;

b) dealing alternately two cards face-down to each of the occupied player positions on said gaming table in rotation from said royal deck of cards, dealing two cards face-down from said royal deck to a dealer position on said gaming table and dealing one card face-up from said royal deck to said dealer position as a first face-up community card to be used as a card of the player's hand;

c) permitting each player, in sequence, after viewing his or her dealt cards and said face-up card at said dealer position, to either stand on the "bet" wager and dealt cards, or double the "bet" wager by placing a first equivalent "additional" wager in front of his or her player position on said gaming table;

d) displaying a first face-down card at the dealer position as a second face-up community card for review by each player to be used as a card of the player's hand;

e) permitting each player in the game, in sequence, after viewing said second face-up community card, to either stand on his or her present wagers, or triple his or her "bet" wager by placing a second equivalent "additional" wager in front of his or her player position;

f) displaying the second face-down card at the dealer position as a third face-up community card for review by each player to be used as a card to complete the player's hand; and g) evaluating each of the remaining player's completed hands to determine whether or not said hands comprise winning hands in accordance with said paytable of winning five-card hands and paying of said winning hands.

10. The method of claim 9 wherein the 20 card royal deck of cards utilized in said five-card stud poker game has added thereto a duce as a wild card for use by a player in his or her hand comprised of the two dealt cards and as may be included in his or her hand as a community card at the dealer position.

11. The method of claim 9 wherein the 20 card royal deck of cards utilized in said five-card stud poker game has added thereto a joker card as a wild card for use by a player in his or her hand comprised of the two dealt cards and as may be included in his or her hand as a community card at the dealer position.

* * * * *